US008281850B2

(12) United States Patent
Beutler et al.

(10) Patent No.: US 8,281,850 B2
(45) Date of Patent: Oct. 9, 2012

(54) EVAPORATOR TUBE WITH OPTIMIZED UNDERCUTS ON THE GROOVE BASE

(75) Inventors: Andreas Beutler, Weissenhorn (DE); Jean El Hajal, Ulm (DE); Andreas Knoepfler, Neu-Ulm (DE); Ronald Lutz, Blaubeuren (DE); Andreas Schwitalla, Voehringen (DE)

(73) Assignee: Wieland-Werke AG, Ulm (DE)

( * ) Notice: Subject to any disclaimer, the term of this patent is extended or adjusted under 35 U.S.C. 154(b) by 471 days.

(21) Appl. No.: 12/322,735

(22) Filed: Feb. 6, 2009

(65) Prior Publication Data

US 2009/0229807 A1 Sep. 17, 2009

(30) Foreign Application Priority Data

Mar. 12, 2008 (DE) ..... 10 2008 013 929

(51) Int. Cl.
*F28F 1/14* (2006.01)

(52) U.S. Cl. ..... 165/184; 165/133

(58) Field of Classification Search ..... 165/133, 165/179, 184

See application file for complete search history.

(56) References Cited

U.S. PATENT DOCUMENTS

| | | | | |
|---|---|---|---|---|
| 3,696,861 | A | 10/1972 | Webb | |
| 4,179,911 | A * | 12/1979 | Saier et al. | 72/78 |
| 4,216,826 | A | 8/1980 | Fujikake | |
| 4,577,381 | A | 3/1986 | Sato et al. | |
| 4,660,630 | A | 4/1987 | Cunningham et al. | |
| 4,796,693 | A | 1/1989 | Kastner et al. | |
| 5,054,548 | A | 10/1991 | Zohler | |
| 5,186,252 | A | 2/1993 | Nishizawa et al. | |
| 5,259,448 | A * | 11/1993 | Masukawa et al. | 165/133 |
| 5,669,441 | A | 9/1997 | Spencer | |
| 5,697,430 | A | 12/1997 | Thors et al. | |
| 6,067,832 | A | 5/2000 | Brand et al. | |
| 6,457,516 | B2 * | 10/2002 | Brand et al. | 165/133 |
| 6,786,072 | B2 * | 9/2004 | Beutler et al. | 72/98 |
| 6,913,073 | B2 | 7/2005 | Beutler et al. | |
| 7,178,361 | B2 | 2/2007 | Thors et al. | |
| 7,225,155 | B1 * | 5/2007 | Polk | 705/40 |
| 7,255,155 | B2 * | 8/2007 | O'Donnell et al. | 165/109.1 |
| 2002/0092644 | A1 | 7/2002 | Beutler et al. | |
| 2007/0151715 | A1 | 7/2007 | Yunyu et al. | |

FOREIGN PATENT DOCUMENTS

| | | | |
|---|---|---|---|
| DE | 27 58 526 | C2 | 7/1979 |
| DE | 197 57 526 | C1 | 4/1999 |
| EP | 0 222 100 | B1 | 5/1987 |
| EP | 0 713 072 | B1 | 5/1996 |
| EP | 1 223 400 | B1 | 7/2002 |
| JP | 04039596 | A | 2/1992 |

* cited by examiner

*Primary Examiner* — Allen Flanigan
*Assistant Examiner* — Indrajit Ghosh
(74) *Attorney, Agent, or Firm* — Flynn, Thiel, Boutell & Tanis, P.C.

(57) ABSTRACT

A metallic heat exchanger tube has fins which run helically around the outside of the tube, are molded integrally therefrom and are of continuous design and the fin base of which protrudes substantially radially from the tube wall, and with primary grooves located between respectively adjacent fins. At least one undercut secondary groove is arranged in the region of the groove base of the primary grooves. The secondary groove is delimited toward the primary groove by a pair of mutually opposite material projections formed from the material of respectively adjacent fin bases and the cross-section thereof is varied at regular intervals without having an influence on the shape of the fins. There is a spacing between the opposite material projections, the spacing being varied at regular intervals, as a result of which local cavities are formed.

7 Claims, 3 Drawing Sheets

EVAPORATOR TUBE WITH OPTIMIZED UNDERCUTS ON THE GROOVE BASE

The invention relates to a metallic heat exchanger tube with ribs which run helically around the outside of the tube and are molded integrally therefrom.

Metallic heat exchanger tubes of this type serve in particular to evaporate liquids from pure substances or mixtures on the outside of the tube.

Evaporation takes place in numerous sectors of refrigeration and air-conditioning engineering and in process and power engineering. Use is frequently made of tubular heat exchangers in which liquids evaporate from pure substances or mixtures on the outside of the tube and, in the process, cool a brine or water on the inside of the tube. Such appliances are known as submerged evaporators.

By making the heat transfer on the outside and inside of the tube more intensive, it is possible to reduce the size of the evaporators considerably. As a result, the production costs of such appliances fall. Moreover, the volume of coolants required is reduced, which is important in view of the fact that the chlorine-free safety coolants which are predominantly used nowadays may form a not insubstantial portion of the overall equipment costs. If toxic or combustible coolants are used, reducing the volume of these coolants furthermore allows the potential hazard to be lowered. The high-power tubes which are customarily used nowadays are already more efficient by a factor of about four than smooth tubes of the same diameter.

It is known to produce such efficient tubes on the basis of integrally rolled finned tubes. Integrally rolled finned tubes are understood to mean finned tubes in which the fins have been molded out of the wall material of a smooth tube. In this connection, various processes are known with which the passages located between adjacent fins are closed in such a manner that connections between passages and the environment remain in the form of pores or slots. In particular, such substantially closed passages are produced by bending over or flanging the fins (U.S. Pat. No. 3,696,861; U.S. Pat. No. 5,054,548; U.S. Pat. No. 7,178,361 B2), by splitting and compressing the fins (DE 2 758 526 C2; U.S. Pat. No. 4,577,381) and by cross-grooving and compression of the fins (U.S. Pat. No. 4,660,630; EP 0 713 072 B1; U.S. Pat. No. 4,216,826).

The most efficient, commercially available finned tubes for submerged evaporators have a fin structure on the outside of the tube, with a fin density of 55 to 60 fins per inch (U.S. Pat. No. 5,669,441; U.S. Pat. No. 5,697,430; DE 197 57 526 CI). This corresponds to a fin pitch of approx. 0.45 to 0.40 mm. In principle, it is possible to improve the efficiency of such tubes by means of an even higher fin density or smaller fin pitch, since the bubble nuclei density is increased by this means. A smaller fin pitch inevitably equally requires more delicate tools. However, more delicate tools are subject to a higher risk of breaking and to more rapid wear. The tools currently available make it possible to reliably manufacture finned tubes with fin densities of at maximum 60 fins per inch. Furthermore, as the fin pitch is decreased, the production speed of the tubes becomes lower and consequently the production costs become higher.

Furthermore, it is known that evaporation structures of increased efficiency can be produced with the fin density on the outside of the tube remaining the same by additional structural elements being introduced in the region of the groove base between the fins. Since the temperature of the fin is higher in the region of the groove base than in the region of the fin tip, structural elements for intensifying the formation of bubbles are particularly effective in said region. Examples thereof can be found in EP 0 222 100 B1; U.S. Pat. No. 5,186,252/JP 04039596A and US 2007/0151715 µl. A common feature of said inventions is that the structural elements on the groove base do not have an undercut form, and therefore they do not intensify the bubble formation sufficiently. It is proposed in EP 1 223 400 B1 to produce undercut secondary grooves on the groove base between the fins, said secondary grooves extending continuously along the primary groove. The cross section of said secondary grooves can remain constant or can be varied at regular spacings.

The invention is based on the object of specifying a heat exchanger tube of increased efficiency for evaporating liquids on the outside of the tube with the same heat transfer and pressure drop at the tube.

The invention includes a metallic heat exchanger tube with fins which run helically around the outside of the tube, are molded integrally therefrom and are of continuous design and the fin base of which protrudes substantially radially from the tube wall, and with primary grooves located between respectively adjacent fins. At least one undercut secondary groove is arranged in the region of the groove base of the primary grooves. Said secondary groove is delimited toward the primary groove by a pair of mutually opposite material projections formed from the material of respectively adjacent fin bases. Said material projections extend continuously along the primary groove. The cross-section of the secondary groove is varied at regular intervals without having an influence on the shape of the fins. There is a spacing between the opposite material projections, said spacing being varied at regular intervals, as a result of which local cavities are formed.

The invention is based here on the finding that, in order to increase the heat transfer during evaporation, the process of nucleate boiling is made more intensive. The formation of bubbles begins at nuclei. Said nuclei are generally small gas or vapor inclusions. When the growing bubble has reached a certain size, it becomes detached from the surface. If, in the course of the bubble becoming detached, the nucleus is flooded with liquid, the nucleus is then deactivated. The surface therefore has to be configured in such a manner that, when the bubble is detached, a small bubble remains behind which then serves as the nucleus for a new bubble formation cycle. This is achieved by cavities with openings being provided on the surface. The opening of the cavity tapers in relation to the hollow space located under the opening. Liquid and vapor are exchanged through the opening.

In the present invention, a connection between the primary and secondary grooves is realized by means of the spacing between the opposite material projections, and therefore liquid and vapor can be exchanged between the primary groove and secondary groove. The particular advantage of the invention is that the undercut secondary groove has a particularly great effect on the formation of bubbles if, according to the invention, the spacing between opposite material projections is varied at regular intervals. As a result, the exchange of liquid and vapor is controlled in a specific manner and the flooding of the bubble nucleus in the cavity is prevented. The position of the cavities in the vicinity of the primary groove base is particularly favorable for the evaporation process, since the excessive temperature of the heat is at the greatest at the groove base and therefore the highest operative difference in temperature is available there for the formation of bubbles.

In a particularly preferred refinement of the invention, the spacing between the opposite material projections can assume the value of zero at regular intervals. As a result, the secondary groove is closed off from the primary groove in certain regions. In said regions, the opposite material projections touch without a cohesive material joint being formed. In this case, the bubbles escape again through the cavities open to the center of the primary groove, and the liquid preferably flows into the cavity from the side in the vicinity of the closed regions of the secondary groove. In the process, the escaping bubble is not obstructed by the inflowing liquid working medium and can expand without disturbance in the primary groove. The respective flow zones of the liquid and the vapor are separated spatially from one another. In addition, even in the closed region of the secondary groove, a small passage is maintained between the cavities, but said passage does not have any connection to the primary groove. Nevertheless, for example, differences in pressure between the mutually adjacent cavities can be compensated for via said passages.

The secondary groove is preferably substantially pressed shut in the regions in which the spacing between the opposite material projections assumes the value of zero. In this refinement, the cavities are no longer connected to one another via the subsections of the secondary groove.

In a preferred embodiment of the invention, the maximum spacing between the opposite material projections can be 0.03 mm to 0.1 mm. In addition, the maximum spacing between the opposite material projections can advantageously be 0.06 mm to 0.09 mm.

In a preferred refinement, the length, in the peripheral direction, of the regions in which the spacing of the opposite material projections does not assume the value of zero can be between 0.2 mm and 0.5 mm. Optimum coordination of the consecutive cavities and regions located in between is thereby obtained.

In a further advantageous refinement of the invention, the fin tips can be deformed in such a manner that they cover and partially close the primary grooves in the radial direction and thus form a partially closed hollow space running helically there around. In this case, the fin tips can have, for example, a substantially T-shaped cross section with pore-like recesses through which the vapor bubbles can escape.

For the configuration of other preferred and advantageous combinations using the solution according to the invention, the publication EP 1 223 400 B1 is incorporated in its entirety into this description.

BRIEF DESCRIPTION OF THE DRAWINGS

Exemplary embodiments of the invention are explained in more detail with reference to the schematic drawings, in which.

DETAILED DESCRIPTION OF THE INVENTION

Mutually corresponding parts are provided with the same reference numbers in all of the figures.

Figure 1:
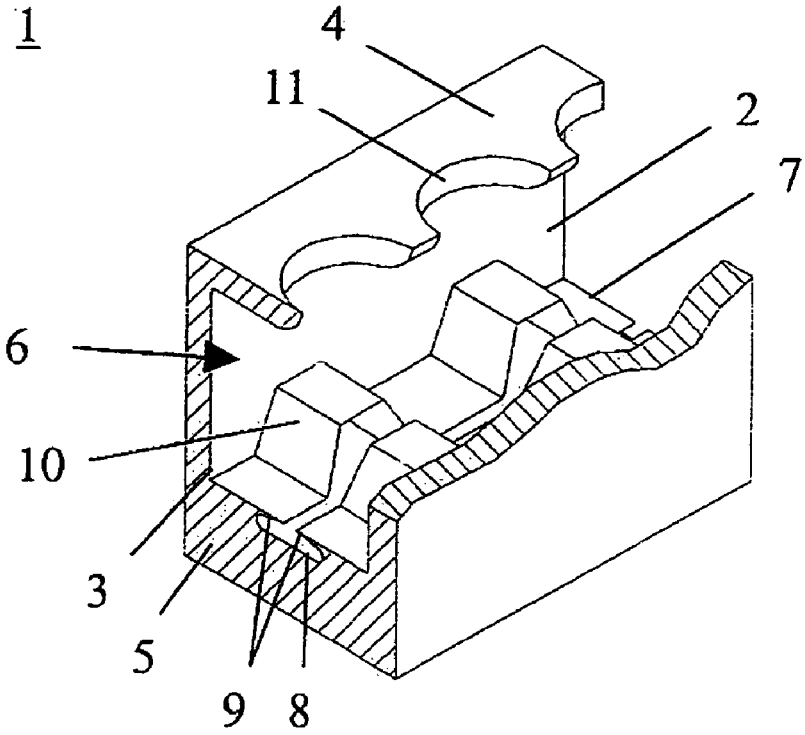
FIG. 1 shows a partial view of the outside of a tube section according to the invention.

FIG. 1 shows a view of the outside of a tube section according to the invention. The integrally rolled finned tube 1 has fins 2 which run helically around the outside of the tube and between which a primary groove 6 is formed. The fins 1 extend continuously without interruption along a helix line on the outside of the tube. The fin base 3 protrudes substantially radially from the tube wall 5. A finned tube 1 is proposed, in which an undercut secondary groove 8 is arranged in the region of the groove base 7 which extends primary grooves 6 located between, in each case, two adjacent fins 2. Said secondary groove 8 is delimited toward the primary groove 6 by a pair of mutually opposite material projections 9 formed from the material of respectively adjacent fin bases 3. Said material projections 9 extend continuously along the primary groove 6, with a spacing S, which is varied at regular intervals, being formed between opposite material projections 9. Variation of the cross-section of the secondary groove 8 does not have any influence on the shape of the fins 2. The cross-sectional change in conjunction with the variation of the spacing S cause the formation locally of cavities 10 which particularly promote the formation of bubble nuclei.

By means of the spacing S between the opposite material projections 9, a connection between the primary groove 6 and secondary groove 8 is formed such that liquid and vapor can be exchanged between the primary groove 6 and secondary groove 8. In regions which have a small spacing S between the material projections 9, liquid preferably passes from the primary groove 6 into the secondary groove 8. The liquid evaporates within the secondary groove 8. The vapor produced preferably emerges from the secondary groove 8 at the locations which have a large spacing between the material projections 9, i.e. in the region of the cavities 10. The vapor bubbles emerging there form nuclei for the further evaporation of liquid in the primary groove 6. For the further evaporation of liquid in the primary groove 6, it is advantageous for the fins 2 to extend continuously along the primary groove 6 on the outside of the tube. By means of the specific variation in the opening width of the secondary groove 8, the exchange of liquid and vapor between the primary groove 6 and secondary groove 8 is controlled by the supply of liquid and outlet of vapor taking place in mutually separated regions. Tubes of the prior art, for example those manufactured according to EP 1 223 400 B1, do not have said advantageous property since, although the cross-sectional shape of the secondary groove 8 is varied, the opening width thereof is not and therefore there are no preferred regions for the supply of liquid and outlet of vapor in each case. The extension of the secondary groove 8 in the radial direction, as measured from the groove base 7, in the regions with a large spacing between the material projections 9 is, at a maximum, 15% of the height H of the fins 2. The fin height H is measured on the finished fin tube 1 from the lowest point of the groove base 7 as far as the fin tip 4 of the fully formed finned tube.

Figure 2:
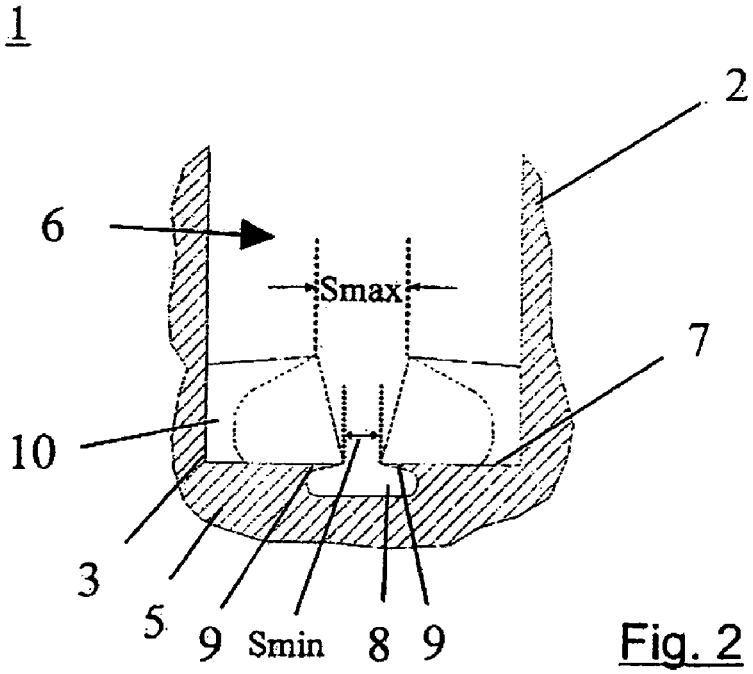
FIG. 2 shows a front view of the tube section according to FIG. 1.

FIG. 2 shows a front view of the tube section according to FIG. 1. In this partial view, the fins 2, which run helically around the outside of the tube, run into the plane of the drawing. The primary groove 6 is formed between the fins 2. The fin base 3 protrudes substantially radially from the tube wall 5. The undercut secondary groove 8 is formed in the region of the groove base 7 which extends primary grooves 6 located between, in each case, two adjacent ribs 2. Said secondary groove 8 is delimited from the primary groove 6 by the opposite material projections 9.

Said material projections 9 extend continuously along the primary groove 6 perpendicularly to the plane of the drawing, with a spacing S which is varied at regular intervals being formed between opposite material projections 9. At different levels, S assumes the minimum value $S_{min}$ in the region between the cavities 10 and the value $S_{max}$ at the highest point of a cavity 10. This cross-sectional change results in the formation locally of cavities 10 with an opening width particularly promoting the formation of bubble nuclei.

Figure 3:
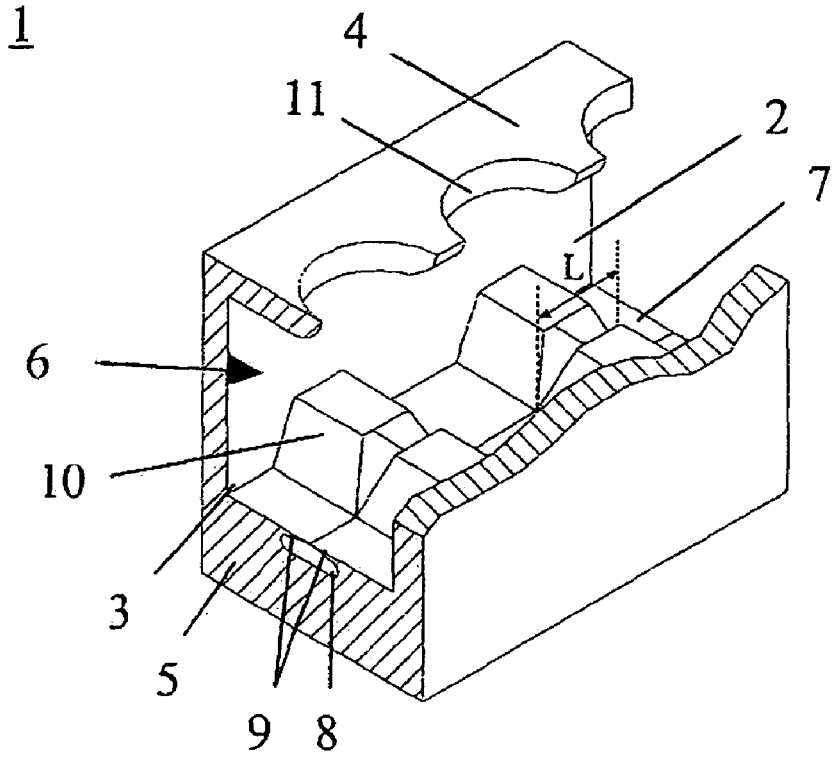
FIG. 3 shows a partial view of the outside of a tube section according to the invention with a secondary groove which is closed in some sections.

FIG. 3 shows a view of the outside of a tube section 1 according to the invention with a partially closed secondary groove 8. In this case, the secondary groove 8 is completely closed toward the primary groove 6 at regular intervals. This corresponds to the situation in which the spacing between the material projections 9 is reduced to zero in certain regions. The secondary groove 8 then only has openings toward the primary groove 6 in the regions located in each case in between, with the width of said openings being reduced at the respective edges thereof.

Figure 4:
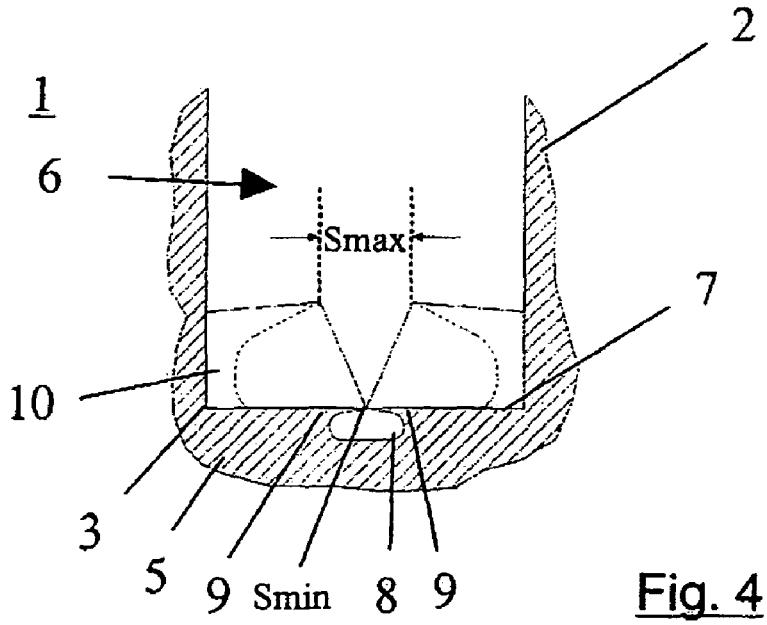
FIG. 4 shows a front view of the tube section according to FIG. 3.

FIG. 4 shows a front view of the tube section according to FIG. 3. The material projections 9 extend again continuously along the primary groove 6 perpendicularly to the plane of the drawing with a spacing S, which is varied at regular intervals, between the opposite material projections 9. While the value $S_{max}$ remains unchanged from FIG. 2 in the region of a cavity at the highest point, S between the cavities 10 assumes the minimum value $S_{min}=0$. In these regions, the opposite material projections 9 touch without a cohesive material joint occurring. The bubbles escape in turn through the cavities 10 which are open into the center of the primary groove 6. Liquid flows into the cavity at the edges of the openings. In the closed region of the secondary groove 8, a small passage is maintained between the cavities 10, said passage not having any connection to the primary groove 6. However, for example, differences in pressure between the mutually adjacent cavities 10 can be compensated for via said passages. The length L of the regions in which the secondary groove is not closed is advantageously between 0.2 mm and 0.5 mm.

Figure 5:
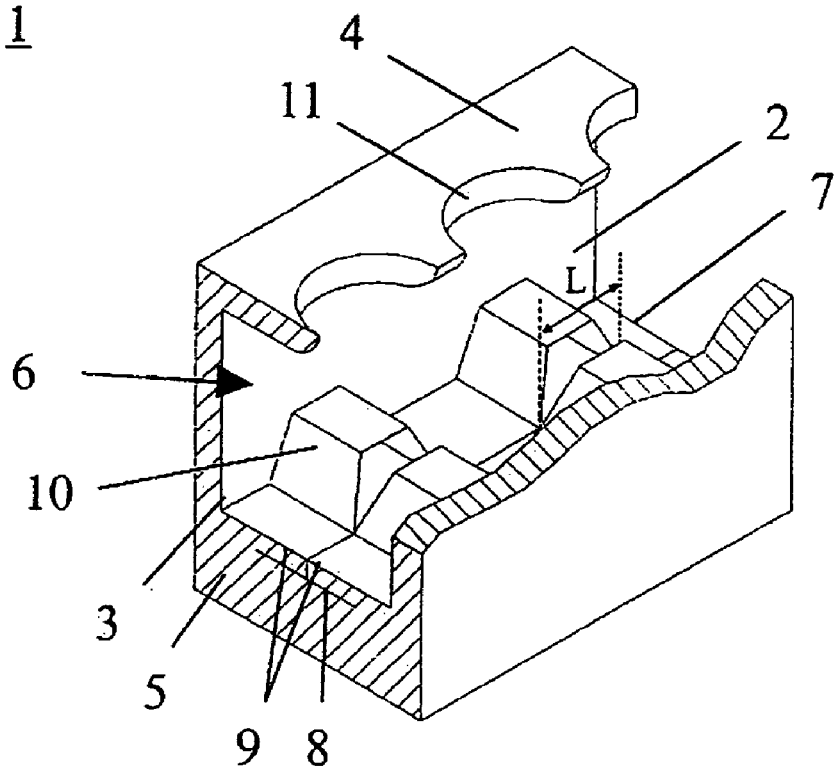
FIG. 5 shows a partial view of the outside of a tube section according to the invention with a secondary groove, which is pressed shut in some sections, between the cavities.

FIG. 5 shows a partial view of the outside of a tube section according to the invention with a completely closed secondary groove between the cavities. As illustrated, it furthermore proves advantageous, in the regions in which the spacing between the material projections 9 is reduced to the value of zero, to deform the material projections 9 to an extent such that they are displaced as far as the bottom of the secondary groove 8 and, therefore, the secondary groove 8 is pressed shut in said region. As a result, in the regions located in between, localized cavities 10, which are expanded to a limited extent entirely in the circumferential direction of the tube, are produced as undercut hollow spaces on the base of the primary groove 6. Said cavities 10 act as extremely effective bubble nuclei, since, in said structures, liquid can flow in after in a highly controlled manner and even particularly small bubbles are not displaced. The bubbles escape in turn through the cavities 10 which are open into the center of the primary groove 6. Liquid flows into the cavity after at the edges of the openings. The length L of the regions in which the secondary groove is not closed is advantageously between 0.2 mm and 0.5 mm.

Figure 6:
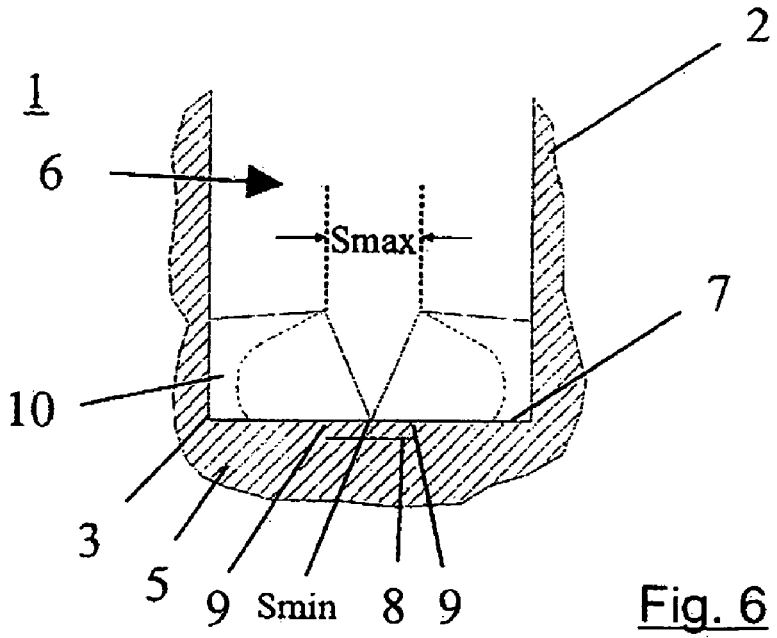
FIG. 6 shows a front view of the tube section according to FIG. 5.

FIG. 6 shows a front view of the tube section according to FIG. 5. As illustrated, it is clarified once again how the material projections 9 are deformed in the regions in which the spacing between the material projections 9 is reduced to the value of zero. Said material projections are displaced as far as the bottom of the secondary groove 8, as a result of which the secondary groove 8 is pressed shut in said region.

The spacing S between the opposite material projections 9 varies between 0 mm and 0.1 mm. In the regions in which said spacing assumes its maximum value $S_{max}$, said value typically lies between 0.03 mm and 0.1 mm, preferably between 0.06 mm and 0.09 mm.

In addition to the formation of the undercut secondary grooves 8 on the groove base 7 of the primary grooves 6, the fin tips, as the distal region 4 of the fins 2, are expediently deformed in such a manner that they partially close the primary grooves 6 in the radial direction and thus form a partially closed hollow space. The connection between the primary groove 6 and surroundings is configured in the form of pores 11 or slots so that vapor bubbles' can escape from the primary groove 6. The fin tips 4 are deformed using methods which can be gathered from the prior art. The primary grooves 6 are then grooves which are undercut themselves.

By means of the combination of the cavities 10 according to the invention with a primary groove 6 which is closed except for pores 11 or slots, a structure is obtained which is furthermore distinguished in that it has a very high degree of efficiency for the evaporation of liquids over a very wide range of operating conditions. In particular, if the heating current density or the operative difference in temperature is varied, the heat transfer coefficient of the structure remains virtually constant at a high level.

The solution according to the invention relates to structured tubes in which the heat transfer coefficient is increased on the outside of the tube. In order not to displace most of the heat transmission resistance to the inside, the heat transfer coefficient on the inside can likewise be made more intense by means of a suitable internal structuring.

The heat exchanger tubes for tubular heat exchangers usually have at least one structured region and smooth end pieces and possibly smooth intermediate pieces. The smooth end and/or intermediate pieces delimit the structured regions. So that the tube can easily be fitted into the tubular heat exchanger, the outer diameter of the structured regions must not be larger than the outer diameter of the smooth end and intermediate pieces.

LIST OF DESIGNATIONS

1 Metallic heat exchanger tube, finned tube
2 Fins
3 Fin base
4 Fin tips, distal regions of the fins
5 Tube wall
6 Primary groove
7 Groove base
8 Secondary groove
9 Material projection
10 Cavity
11 Pores
S Spacing between opposite material projections
$S_{max}$ Maximum spacing between opposite material projections
$S_{min}$ Minimum spacing between opposite material projections
L Length in the peripheral direction of the regions in which the spacing S is not equal to zero

The invention claimed is:

1. A metallic heat exchanger tube (1) comprising fins (2) which run in a helical direction around the outside of the tube, are molded integrally from the tube, and are of continuous design; a fin base (3) which protrudes substantially radially from a tube wall (5); and a primary groove (6) located between respectively adjacent fins (2), wherein an undercut secondary groove (8) extends in said helical direction and is arranged in the region of a groove base (7) of the primary groove (6), said secondary groove (8) is delimited toward the primary groove (6) by a pair of mutually opposite material projections (9) formed from a material of respectively adjacent fin bases (3), said material projections (9) extend continuously along the primary groove (6), the cross-section of the secondary groove (8) is varied at regular intervals along said helical direction without having an influence on the shape of the fins (2), and there is a spacing (S) between opposite material projections (9), characterized in that said spacing (S) is varied at regular intervals, as a result of which local cavities (10) are formed.

2. The metallic heat exchanger tube according to claim 1, characterized in that the spacing (S) between the opposite material projections (9) assumes the value of zero at regular intervals.

3. The metallic heat exchanger tube according to claim 2, characterized in that the secondary groove (8) is substantially pressed shut in the regions in which the spacing between the opposite material projections (9) assumes the value of zero.

4. The metallic heat exchanger tube according to claim 1, characterized in that the maximum spacing ($S_{max}$) between the opposite material projections (9) is 0.03 mm to 0.1 mm.

5. The metallic heat exchanger tube according to claim 4, characterized in that the maximum spacing ($S_{max}$) between the opposite material projections (9) is 0.06 mm to 0.09 mm.

6. The metallic heat exchanger tube according to claim 1, characterized in that a length (L), measured in the peripheral direction, of the regions in which the spacing (S) of the opposite material projections (9) does not assume the value of zero is between 0.2 mm and 0.5 mm.

7. The metallic heat exchanger tube according to claim 1, characterized in that fin tips (4) are deformed in such a manner that they cover and partially close the primary grooves (6) in a radial direction and thus form a partially closed hollow space running helically therearound.

* * * * *